US011128966B2

(12) United States Patent
Ayache et al.

(10) Patent No.: US 11,128,966 B2
(45) **Date of Patent: *Sep. 21, 2021**

(54) CHARGING AND DRYING STATION FOR HEARING AID DEVICE

(71) Applicant: Serene Group, Inc., Norwalk, CA (US)

(72) Inventors: Jamal M. Ayache, La Mirada, CA (US); Peter Lee, Huntington Beach, CA (US)

( * ) Notice: Subject to any disclaimer, the term of this patent is extended or adjusted under 35 U.S.C. 154(b) by 31 days.

This patent is subject to a terminal disclaimer.

(21) Appl. No.: 16/097,613

(22) PCT Filed: Jun. 8, 2018

(86) PCT No.: PCT/US2018/036776

§ 371 (c)(1),
(2) Date: Aug. 20, 2019

(87) PCT Pub. No.: WO2019/236109

PCT Pub. Date: Dec. 12, 2019

(65) Prior Publication Data

US 2021/0037327 A1 Feb. 4, 2021

(51) Int. Cl.
*H04R 25/00* (2006.01)
*H04R 1/10* (2006.01)

(52) U.S. Cl.
CPC ..... *H04R 25/602* (2013.01); *H04R 1/1025* (2013.01); *H04R 25/65* (2013.01); *H04R 2225/31* (2013.01)

(58) Field of Classification Search
CPC .... H04R 25/602; H04R 1/1025; H04R 25/65; H04R 2225/31
USPC ..... 381/323
See application file for complete search history.

(56) References Cited

U.S. PATENT DOCUMENTS 5,640,783 A * 6/1997 Schumaier ..... A61L 2/07 34/219
6,399,920 B1 * 6/2002 Guinn ..... F26B 9/003 219/386
7,823,598 B2 * 11/2010 Stern ..... B08B 3/10 134/116
9,843,870 B2 * 12/2017 Naumann ..... H04R 25/30
10,424,955 B2 * 9/2019 Higgins ..... H01R 13/2414
(Continued)

FOREIGN PATENT DOCUMENTS

EP 2493215 A1 * 8/2012 ..... F26B 21/10
WO WO-2011059461 A1 * 5/2011 ..... F26B 9/003
WO WO-2019236109 A1 * 12/2019 ..... F26B 3/04

*Primary Examiner* — Phylesha Dabney
(74) *Attorney, Agent, or Firm* — Tsz Lung Yeung

(57) ABSTRACT

A charging and drying station includes a main casing having a receiving cavity, a drying arrangement and a charger accommodation arrangement. The charger accommodation arrangement includes a utility platform securely mounted on the main casing. The utility platform has a through charger accommodating slot, wherein the charger accommodating slot is shaped and sized to fittedly accommodate at least the charging terminal of the hearing aid charger when the hearing aid charger is detachably accommodated in the receiving cavity, so that the hearing aid device is capable of being disposed on the utility platform for being simultaneously recharged and dried by the hearing aid charger and the drying arrangement respectively.

19 Claims, 5 Drawing Sheets

(56) References Cited

U.S. PATENT DOCUMENTS

| | | | | |
|---|---|---|---|---|
| 2004/0244215 | A1* | 12/2004 | Greenspan | F26B 21/083 34/80 |
| 2008/0128007 | A1* | 6/2008 | Stern | B08B 3/10 134/58 R |
| 2009/0296968 | A1* | 12/2009 | Wu | H04R 25/00 381/323 |
| 2010/0011613 | A1* | 1/2010 | Husung | F26B 9/003 34/443 |
| 2012/0216418 | A1* | 8/2012 | Serman | F26B 9/003 34/282 |
| 2016/0006292 | A1* | 1/2016 | Hatanaka | H02J 50/00 320/108 |
| 2019/0297437 | A1* | 9/2019 | Gil | F26B 9/003 |
| 2020/0245079 | A1* | 7/2020 | Ayache | F26B 9/06 |
| 2020/0267483 | A1* | 8/2020 | Schumaier | F26B 3/04 |

* cited by examiner

CHARGING AND DRYING STATION FOR HEARING AID DEVICE

BACKGROUND OF THE PRESENT INVENTION

Field of Invention

The present invention relates to a hearing aid accessory, and more particularly to a charging and drying station for a hearing aid device, wherein a user may simultaneously recharge and dry his hearing aid device through the use of an existing hearing aid charger and the present invention.

Description of Related Arts

Hearing aids have been widely utilized throughout the world. A typical behind-the-ear hearing aid may comprise a housing which is adapted to be hung behind a user's pinna, and an earplug extended from the housing and arranged to be inserted into an external auditory canal of the user. The hearing aid may comprise a speaker/receiver and microphone module which is normally received in the housing. A rechargeable battery may be provided in the housing for powering up the entire hearing aid. An electrical terminal may be provided on the housing.

Two common hearing aid accessories are chargers and dryers. Hearing aid chargers are used to recharge the rechargeable battery while dryers may be used to remove moisture from the hearing aids. Conventionally, recharging and drying are two separate processes and a user has to use two different accessories to accomplish charging and drying. This imparts great inconvenient to users.

As a result, there is a need to develop an accessory for a hearing aid device which may resolve the above-mentioned problem and allow a user to charge and dry his hearing aid devices at the same time.

SUMMARY OF THE PRESENT INVENTION

Certain variations of the present invention provide a charging and drying station for a hearing aid device, wherein a user may simultaneously recharge and dry his hearing aid device through the use of an existing hearing aid charger and the present invention.

Certain variations of the present invention provide a charging and drying station for a hearing aid device, wherein a user may store the hearing aid device in a main casing which is designed to be of portable use. In other words, the present invention may provide a portable charging station when the hearing aid charger is accommodated in the charging and drying station.

In one aspect of the present invention, it provides a charging and drying station for a hearing aid charger having a charging terminal to charge a hearing aid device, the charging and drying station comprising:

a main casing having a receiving cavity;

a drying arrangement accommodated in the receiving cavity, the drying arrangement comprising at least one of an air dryer and a thermal dryer mounted in the receiving cavity for drying the hearing aid device; and a charger accommodation arrangement, which comprises a utility platform securely mounted on the main casing, the utility platform having a through charger accommodating slot, wherein the charger accommodating slot is shaped and sized to fittedly accommodate at least the charging terminal of the hearing aid charger when the hearing aid charger is detachably accommodated in the receiving cavity, so that the hearing aid device is capable of being disposed on the utility platform for being simultaneously recharged and dried by the hearing aid charger and the drying arrangement respectively.

This summary presented above is provided merely to introduce certain concepts and not to identify any key or essential features of the claimed subject matter.

DETAILED DESCRIPTION OF THE PREFERRED EMBODIMENT

Figure 1:
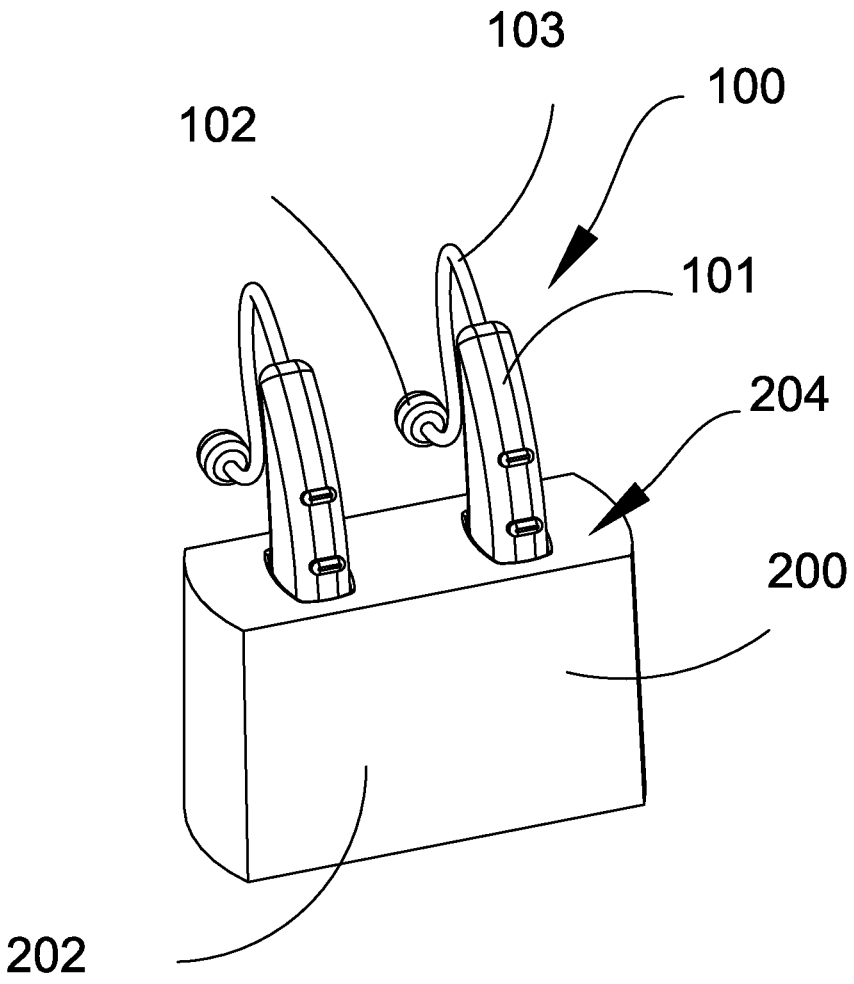
FIG. 1 is a schematic diagram illustrating two hearing aid devices are being charged by a hearing aid charger.
Figure 2:
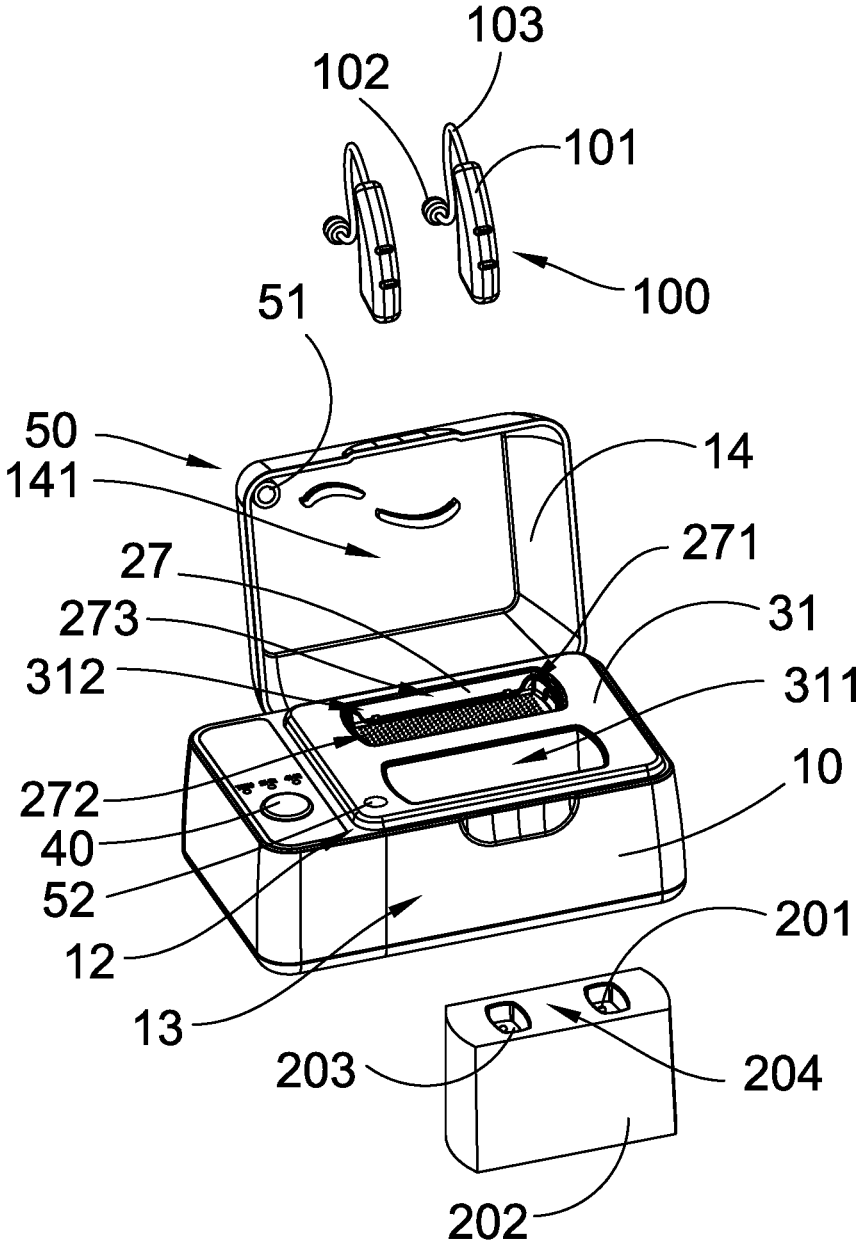
FIG. 2 is a perspective view of the charging and drying station for a hearing aid device according to the preferred embodiment of the present invention.
Figure 3:
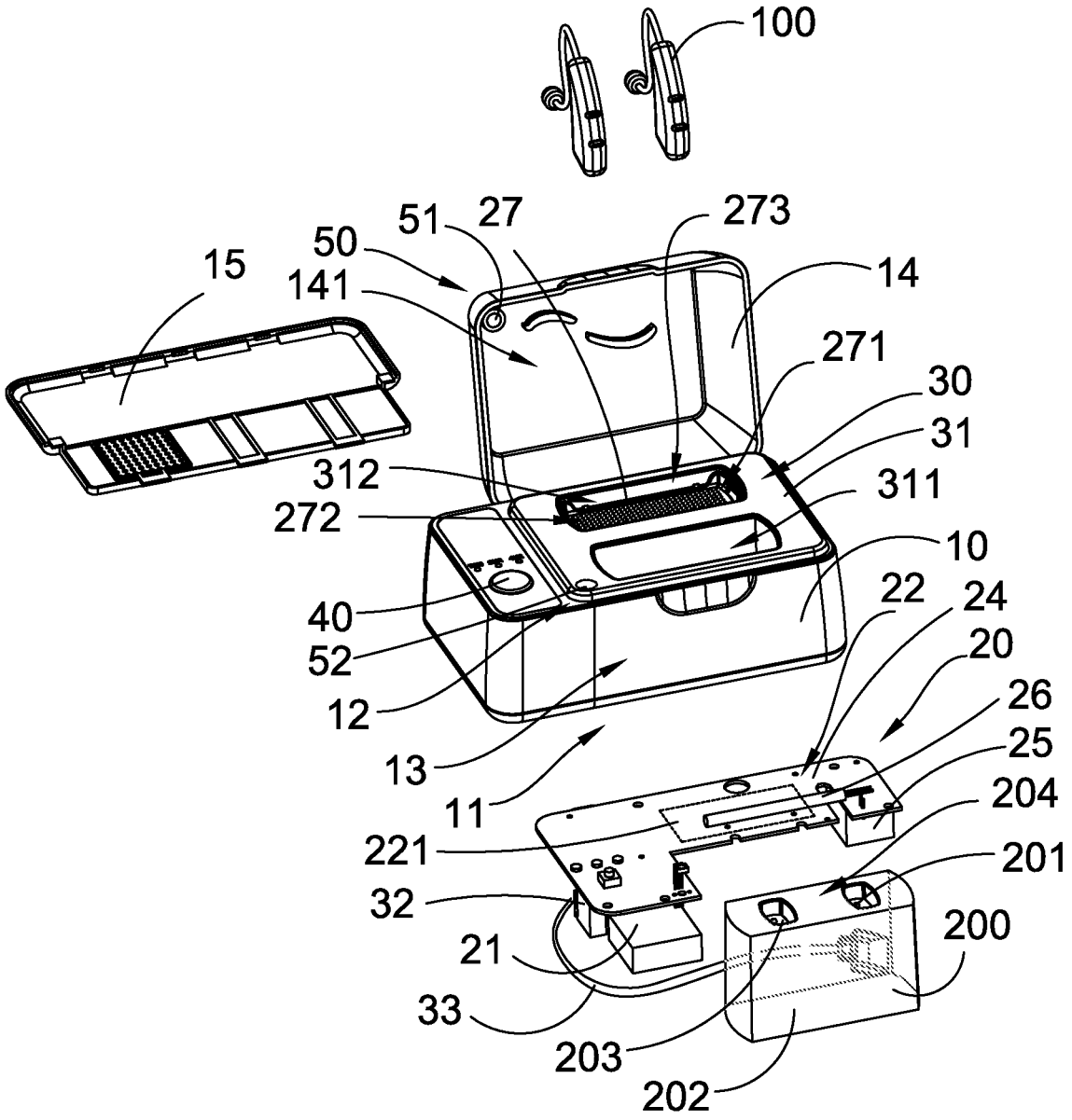
FIG. 3 is exploded perspective view of the charging and drying station for a hearing aid device according to the preferred embodiment of the present invention.
Figure 4:
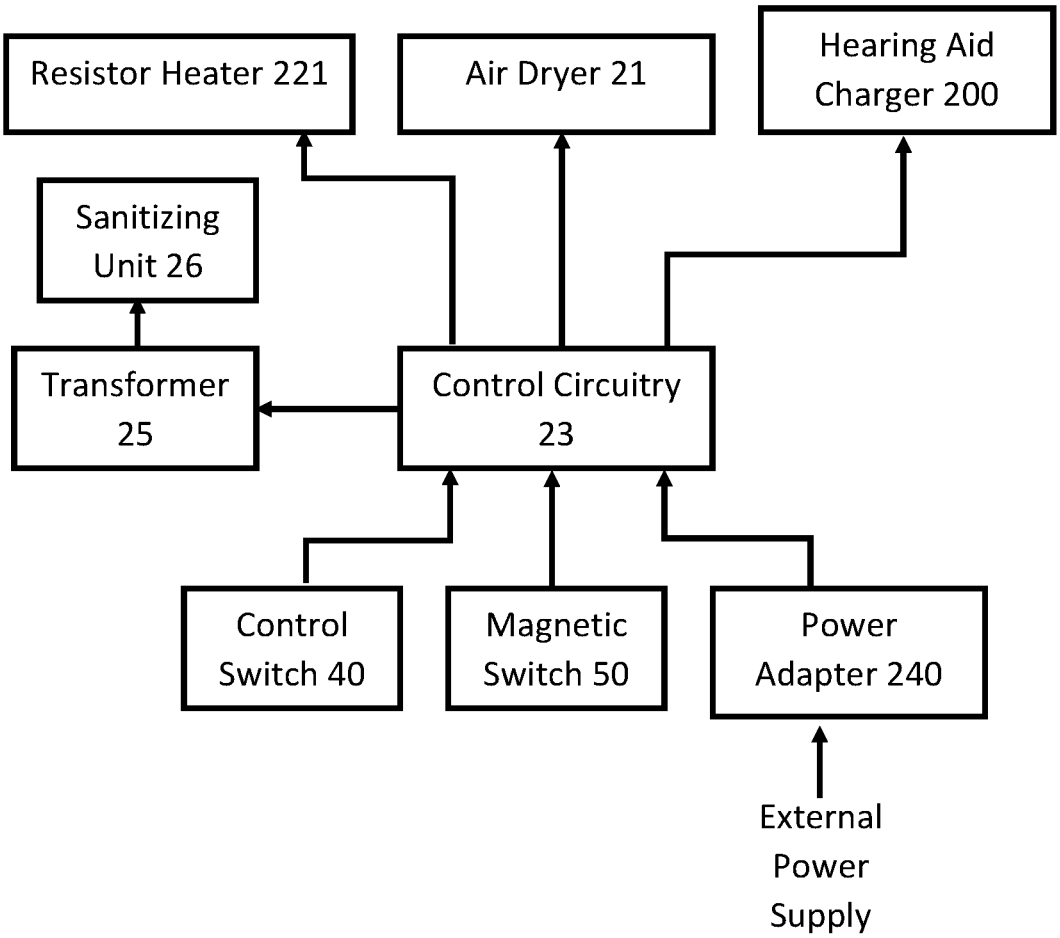
FIG. 4 is a schematic block diagram of the charging and drying station for a hearing aid device according to the preferred embodiment of the present invention.

The following detailed description of the preferred embodiment is the preferred mode of carrying out the invention. The description is not to be taken in any limiting sense. It is presented for the purpose of illustrating the general principles of the present invention.

Referring to FIG. 1 to FIG. 4 of the drawings, a charging and drying station according a preferred embodiment of the present invention is illustrated. The charging and drying station may be primarily for use with a hearing aid charger 200 having at least one charging terminal 201 to charge at least one hearing aid device 100. Broadly, the charging and dryer station may comprise a main casing 10 having a receiving cavity 11, a drying arrangement 20, and a charger accommodation arrangement 30.

The drying arrangement 20 may be accommodated in the receiving cavity 11. The drying arrangement 20 may comprise at least one of an air dryer 21 and a thermal dryer 22 mounted in the receiving cavity 11 for drying the hearing aid device 100.

The charger accommodation arrangement 30 may comprise a utility platform 31 securely mounted on the main casing 10. The utility platform 31 may have a through charger accommodating slot 311 which may be shaped to fittedly accommodate at least the charging terminal 201 of the hearing aid charger 200 when the hearing aid charger 200 is detachably accommodated in the receiving cavity 11, so that the hearing aid device 100 is capable of being disposed on the utility platform 31 for being simultaneously recharged and dried by the hearing aid charger 200 and the drying arrangement 20 respectively.

According to the preferred embodiment of the present invention, the charging and drying station may be primarily for use with a predetermined hearing aid charger 200 having at least one charging terminal 201. The hearing aid charger 200 may be a leading hearing aid charger in the market. The size and shape of this hearing aid charger 200 may be utilized to design the size and shape of the receiving cavity 11 and the through charger accommodating slot 311.

FIG. 1 illustrates charging of two hearing aid devices 100 by a hearing aid charger 200. Each of the hearing aid devices 100 may comprise a housing 101, an earplug 102, and an extension cord 103 extended between the housing 101 and the earplug 102. The earplug 102 and the extension cord 103 may be made of flexible and soft material while the housing 101 may be made of rigid material. Electronic components may be received in the housing 101. The two hearing aid devices 100 may be conventional and well-known in the art.

The hearing aid charger 200 may also be a conventional charger for a hearing aid device. FIG. 1 illustrates one predetermined type of hearing charger in which it may comprise a charger body 202, a plurality of charging adapters 203 provided on a top surface 204 of the charger body 202, wherein each of the charging adapters 203 may have a charging terminal 201 provided thereon. The housings 101 of the hearing aid devices 100 may be securely disposed on the charging adapters 203 respectively for charging of the hearing aid devices 100. Again, the hearing aid charger 200 may be conventional and well-known in the art.

The main casing 10 may have a top surface 12 and a boundary surface 13. The charging and drying station may further comprise a covering member 14 movably mounted on the main casing 10 for selectively covering the utility platform 31 of the charger accommodation arrangement 30.

On the other hand, the receiving cavity 11 may be formed as a space surrounded between the top surface 12, the utility platform 31, and the boundary surface 13. The receiving cavity 11 may formed as a cavity inside the main casing 10. In this preferred embodiment, the main casing 10 may have a substantially rectangular cross-sectional shape. However, depending on manufacturing and marketing circumstances, the main casing 10 may also be configured to have any other cross-sectional shape.

The charging and drying station may further comprise a bottom cover 15 detachably attached on a bottom side of the main casing 10. When the bottom cover 15 is detached from the main casing 10, a user may be able to accommodate the hearing aid charger 200 in the receiving cavity 11.

The drying arrangement 20 may further comprise a control circuitry 23 implemented on a Printed Circuit Board (PCB 24). The PCB 24 may be securely supported in the receiving cavity 11. The air dryer 21 may be electrically connected to the PCB 24 for being controlled by the control circuitry 23. The control circuitry 23 may serve as a central circuit for controlling all other electrical components of the charging and drying station of the present invention. The PCB 24 may be electrically connected to an external power source, preferably through an externally connected power adapter 240, for acquiring electricity for the entire charging and drying station.

The drying arrangement 20 may further comprise a sanitizing unit 26 provided in the receiving cavity 11 and electrically connected to the PCB 24 and the control circuitry 23 for sanitizing the hearing aid device 100 when it is disposed on the utility platform 31. The sanitizing unit 26 may be configured as an ultra-violet (UV) generator mounted on a top side of the PCB 24 so that when the sanitizing unit 26 is activated, it may be arranged to generate ultra-violet radiation primarily toward the utility platform 31 for sanitizing the hearing aid device 100.

In order to optimize power supply to the sanitizing unit 26, the drying arrangement 20 may further comprise a power transformer 25 supported in the receiving cavity 11 and electrically connected to the PCB 24 and the control circuitry 23. The power transformer 25 may also be electrically connected to the sanitizing unit 26 and arranged to provide electrical power to the sanitizing unit 26. The power transformer 25 may acquire electrical power from the PCB 24, and this available electrical supply on the PCB 24 may be transformed into a predetermined voltage and current for use by the sanitizing unit 26. Thus, when the control circuitry 23 is actuated (described below), the control circuitry 23 may supply power to the air dryer 21, the thermal dryer 22, and sanitizing unit 26 and drive these components to operate accordingly.

The charger accommodation arrangement 30 may be configured to allow a user to dry and charge his hearing aid device 100 simultaneously. The utility platform 31 may further comprise a through dryer slot 312 formed adjacent to the through charger accommodating slot 311, while the drying arrangement 20 may further comprise a supporting tray 27 mounted on the through dryer slot 312. The supporting tray 27 may have a drying cavity 271 indently formed thereon, and a plurality of meshes 272 formed on a surrounding boundary 273 of the drying cavity 271. The drying cavity 271 may be shaped and sized to accommodate at least the earplug 102 of the hearing aid device 100 so that the earplug 102 may rest in the drying cavity 271 for being dried by the drying arrangement 20. Thus, the meshes 272 may communicate the receiving cavity 11 with the drying cavity 271.

According to the preferred embodiment of the present invention, the drying arrangement 20 may comprise both the air dryer 21 and the thermal dryer 22. The air dryer 21 may be configured as a fan unit which may be arranged to deliver air flow. On the other hand, the thermal dryer 22 may comprise at least one resistor heater 221 mounted on the PCB 24, wherein the air circulated from the air dryer 21 may be arranged to thermally communicate with the resistor heater 221 for being heated. The heated air may then be circulated toward the drying cavity 271 through the meshes 272.

The charger accommodation arrangement 30 may further comprise a power port 32 provided on the PCB 24, and a power cable 33 extended from the power port 32 for electrically connecting to the hearing aid charger 200 so as to supply electricity thereto. Specifically, the power port 32 may be configured as a USB power port and the power cable 33 may connect the hearing aid charger 200 to the power port 32 when the hearing aid charger 200 is accommodated in the receiving cavity 11. The power supplied to the hearing aid charger 200 through the power port 32 may be used to recharge the hearing aid charger 200 for recharging the hearing aid device 100.

In this preferred embodiment, the through charger accommodating slot 311 of the utility platform 31 may be shaped and sized to accommodate the top surface 204 of the hearing aid charger 200, while the charging adapters 203 are provided on the top surface 204 of the hearing aid charger 200. Thus, when the hearing aid charger 200 is properly accommodated in the receiving cavity 11, the top surface 204 and the charging adapter 203 may expose to an exterior of the receiving cavity 11 through the through charger accommodating slot 311. A user may then charge the hearing aid device 100 by connecting the hearing aid device 100 to the charging adapter 203 while placing the hearing aid device 100 on the utility platform 31.

The covering member 14 may be pivotally mounted to the main casing 10 and may have a covering cavity 141 for accommodating the hearing aid device 100. The covering member 14 may be pivotally moved to expose the drying cavity 271 and the hearing aid device 100 to ambient environment. On the other hand, the covering member 14 may also be pivotally moved to rest on the main casing 10 so as to substantially enclose and protect the hearing aid device 100 and the supporting tray 27.

Moreover, the charging and drying station may further comprise a magnetic switch 50 provided on the main casing 10. Specifically, the magnetic switch 50 may comprise a first magnetic member 51 provided on the covering member 14 and a second magnetic member 52 provided in the receiving cavity 11 and electrically connected to the control circuitry 23 and the PCB 24, in such a manner that when the covering member 14 is moved to enclose the hearing aid device 100, the first magnetic member 51 and the second magnetic member 52 may be magnetically attracted with each other to activate operation of the drying arrangement 20 and/or charging function.

The charging and drying station may further comprise a control switch 40 provided on the main casing 10 and electrically connected to the control circuitry 23, wherein a user may control an operation of the charging and drying station through actuating the control switch 40.

The operation of the present invention is as follows: the charging and drying station of the present invention does not come with a hearing aid charger 200. Rather, the present invention is for accommodating a predetermined hearing aid charger 200 which is adapted to charge a hearing aid device 100. The charging and drying station of the present invention may be sized and shaped to simultaneously dry and charge two hearing aid devices 100. Thus, a user may insert the hearing aid charger 200 in the receiving cavity 11 and connect the power cable 33 to a built-in charging socket of the hearing aid charger 200. After that, the user may close the bottom cover 15 so that the hearing aid charger 200 may be securely supported and accommodated in the receiving cavity 11. At the same time, the charging adapters 203 may expose to ambient environment through the through charger accommodating slot 311.

Referring to FIG. 1 of the drawings, a user may then connect the hearing aid devices 100 to the charging adapters 203 in the through charger accommodating slot 311 while the earplug 102 of each of the hearing aid devices 100 may extend and rest in the drying cavity 271 of the adjacently positioned supporting tray 27 (in the through dryer slot 312). The user may then close the covering member 14 and turn on the air dryer 21 and the thermal dryer 22, and/or the sanitizing unit 26 by operating on the control switch 40. Thus, the hearing aid devices 100 may be recharged and dried simultaneously by using the present invention.

Moreover, the sanitizing unit 26 of the drying arrangement 20 may generate ultraviolet radiation which may reach the hearing aid devices 100 through the meshes 272 of the supporting tray 27. A user of the present invention may choose which functions to be used for one or both of his hearing aid devices 100. For example, the user may activate both the drying and sanitizing functions for both of his hearing aid devices 100 by manually operating on the control switch 40.

Note that the charging and drying station of the present invention may be built for many types of hearing aid chargers. By altering the size and shape of the through charger accommodating slot 311 and by suitably programming the control circuitry 23, the present invention may be used in conjunction with many commercially available hearing aid chargers.

The control circuitry 23 may be configured to recharge the hearing aid charger 200 when it is accommodated in the receiving cavity 11 and electrically connected to the control circuitry 23 through the power port 32. The control circuity 23 may acquire the necessary power from an external power source.

Moreover, the hearing aid charger 200 may also be inserted into the receiving cavity 11 through alternative orientations. For example, the utility platform 31 may be detachably attached on the top surface 12 of the main casing so that a user may be able to detach the utility platform 31 from the main casing 10 and insert the hearing aid charger 200 from a top side of the main casing 10. The hearing aid charger 200 may then be connected to the PCB 24. After insertion and properly connected, the user may attach the utility platform 31 back to the main casing 10. The charging and drying station may then work in the manner described above.

Figure 5:
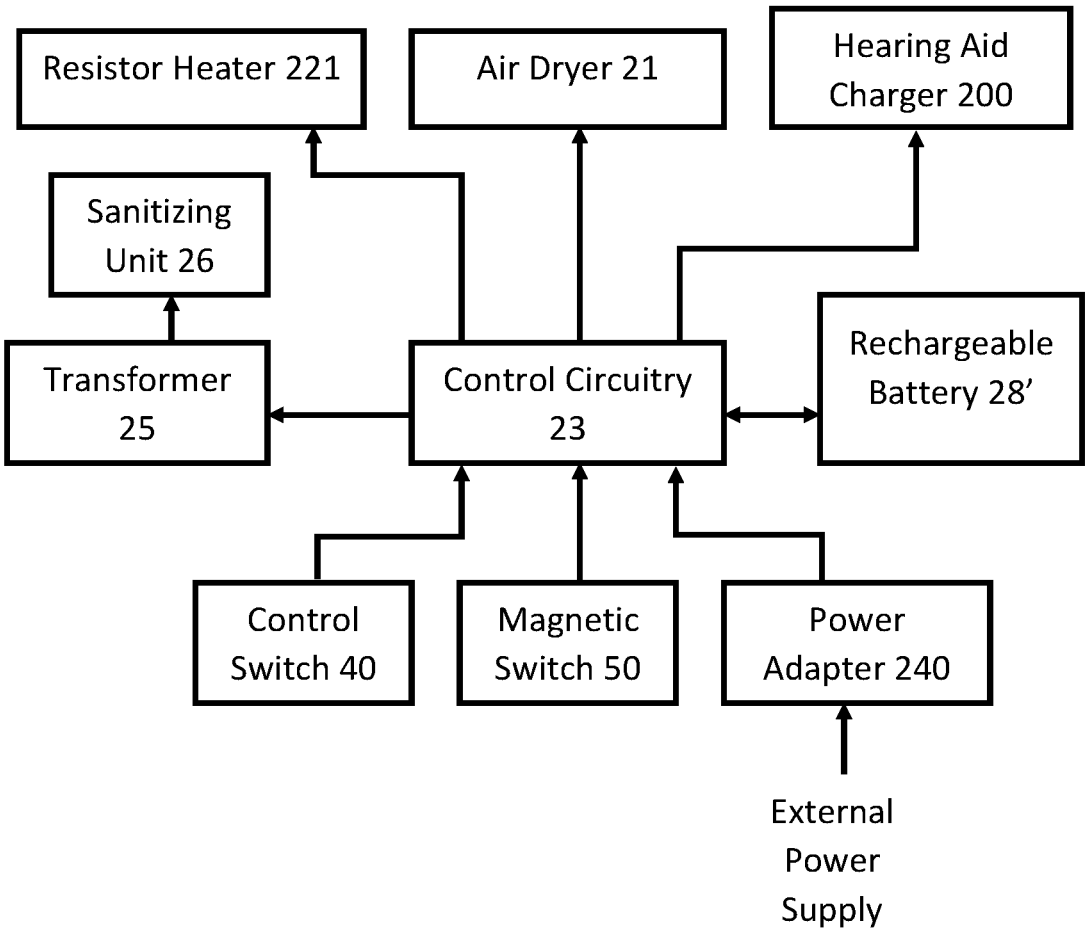
FIG. 5 is a schematic block diagram of the charging and drying station for a hearing aid device according to a first alternative mode of the preferred embodiment of the present invention.

Referring to FIG. 5 of the drawings, a first alternative mode of the charging and drying station according to the preferred embodiment of the present invention is illustrated. The first alternative mode is identical to the preferred embodiment described above, except the drying arrangement 20 may further comprise a rechargeable battery 28' received in the receiving cavity 11 of the main casing 10 and electrically connected to the control circuitry 23 on the PCB 24 such that the entire drying and charging station may be powered from this rechargeable battery 28' when external power supply is not available. This rechargeable battery 28' may be automatically recharged when external power source is connected to the PCB 24, whether or not through the power adapter 240.

The present invention, while illustrated and described in terms of a preferred embodiment and several alternatives, is not limited to the particular description contained in this specification. Additional alternative or equivalent components could also be used to practice the present invention.

What is claimed is:

1. A charging and drying station for a hearing aid charger having a charging terminal to charge a hearing aid device which comprises a housing and an earplug, said charging and drying station comprising:

a main casing having a receiving cavity;

a drying arrangement accommodated in said receiving cavity, said drying arrangement comprising at least one of an air dryer and a thermal dryer mounted in said receiving cavity for drying said hearing aid device; and a charger accommodation arrangement, which comprises a utility platform mounted on said main casing, said utility platform having a through charger accommodating slot, wherein said charger accommodating slot is shaped and sized to fittedly accommodate at least said charging terminal of said hearing aid charger when said hearing aid charger is detachably accommodated in said receiving cavity, so that said hearing aid device is capable of being disposed on said utility platform for being simultaneously recharged and dried by said hearing aid charger and said drying arrangement respectively, wherein said utility platform further comprises a through dryer slot formed adjacent to said through charger accommodating slot, while said drying arrangement further comprises a supporting tray mounted on said through dryer slot for supporting at least said earplug of said hearing aid.

2. The charging and drying station, as recited in claim 1, wherein said supporting tray has a drying cavity indently formed thereon, and a plurality of meshes formed on a surrounding boundary of said drying cavity for communicating said receiving cavity with said drying cavity.

3. The charging and drying station, as recited in claim 2, wherein said through charger accommodating slot of said utility platform is shaped and sized to accommodate a top surface of said hearing aid charger so that when said hearing aid charger is accommodated in said receiving cavity, said top surface is exposed to an exterior of said receiving cavity through said through charger accommodating slot.

4. The charging and drying station, as recited in claim 3, further comprising a bottom cover detachably attached on a bottom side of said main casing, wherein when said bottom cover is detached from said main casing, said hearing aid charger is capable of being disposed and accommodated in said receiving cavity.

5. The charging and drying station, as recited in claim 4, wherein said utility platform is detachably attached on said main casing such that said hearing aid charger is capable of being inserted into said receiving cavity when said utility platform is detached from said main casing.

6. The charging and drying station, as recited in claim 5, wherein said main casing has a top surface and a boundary surface, said receiving cavity being formed as a space surrounded by said top surface, and said boundary surface underneath said utility platform.

7. The charging and drying station, as recited in claim 6, wherein said drying arrangement further comprises a PCB and a control circuitry implemented on said PCB, said PCB being securely supported in said receiving cavity, said corresponding air dryer and said thermal dryer being electrically connected to said control circuitry and said PCB for being controlled by said control circuitry.

8. The charging and drying station, as recited in claim 7, wherein said charger accommodation arrangement further comprises a power port provided on said PCB, and a power cable extended from said power port for electrically connecting to said hearing aid charger when said hearing aid charger is accommodated in said receiving cavity.

9. The charging and drying station, as recited in claim 8, wherein said drying arrangement further comprises a rechargeable battery electrically connected to said control circuitry and said PCB for supplying power to said corresponding air dryer, said thermal dryer and said hearing aid charger.

10. The charging and drying station, as recited in claim 8, wherein said control circuitry is configured to provide power to recharge said hearing aid charger when said hearing aid charger is accommodated in said receiving cavity and electrically connected to said control circuitry.

11. The charging and drying station, as recited in claim 8, wherein said drying arrangement further comprises a sanitizing unit provided in said receiving cavity and electrically connected to said PCB and said control circuitry for sanitizing said hearing aid device when said hearing aid device is disposed on said utility platform.

12. The charging and drying station, as recited in claim 11, further comprising a magnetic switch which comprises a first magnetic member provided on said covering member and a second magnetic member provided in said receiving cavity and electrically connected to said control circuitry and said PCB, such that when said covering member is moved to enclose said hearing aid device, said first magnetic member and said second magnetic member is magnetically connected with each other to activate a predetermined operation of said charging and drying station.

13. The charging and drying station, as recited in claim 12, wherein said drying arrangement further comprises a rechargeable battery electrically connected to said control circuitry and said PCB for supplying power to said corresponding air dryer, said thermal dryer and said hearing aid charger.

14. The charging and drying station, as recited in claim 13, wherein said control circuitry is configured to provide power to recharge said hearing aid charger when said hearing aid charger is accommodated in said receiving cavity and electrically connected to said control circuitry.

15. The charging and drying station, as recited in claim 4, wherein said main casing has a top surface and a boundary surface, said receiving cavity being formed as a space surrounded by said top surface, and said boundary surface underneath said utility platform.

16. The charging and drying station, as recited in claim 15, wherein said drying arrangement further comprises a PCB and a control circuitry implemented on said PCB, said PCB being securely supported in said receiving cavity, said corresponding air dryer and said thermal dryer being electrically connected to said control circuitry and said PCB for being controlled by said control circuitry.

17. The charging and drying station, as recited in claim 16, wherein said charger accommodation arrangement further comprises a power port provided on said PCB, and a power cable extended from said power port for electrically connecting to said hearing aid charger when said hearing aid charger is accommodated in said receiving cavity.

18. The charging and drying station, as recited in claim 17, wherein said drying arrangement further comprises a sanitizing unit provided in said receiving cavity and electrically connected to said PCB and said control circuitry for sanitizing said hearing aid device when said hearing aid device is disposed on said utility platform.

19. The charging and drying station, as recited in claim 18, further comprising a magnetic switch which comprises a first magnetic member provided on said covering member and a second magnetic member provided in said receiving cavity and electrically connected to said control circuitry and said PCB, such that when said covering member is moved to enclose said hearing aid device, said first magnetic member and said second magnetic member is magnetically connected with each other to activate a predetermined operation of said charging and drying station.

* * * * *